US006250090B1

(12) United States Patent
Mei et al.

(10) Patent No.: US 6,250,090 B1
(45) Date of Patent: Jun. 26, 2001

(54) APPARATUS AND METHOD FOR EVAPORATOR DEFROSTING

(75) Inventors: Viung C. Mei, Oak Ridge; Fang C. Chen; Ronald E. Domitrovic, both of Knoxville, all of TN (US)

(73) Assignee: Lockheed Martin Energy Research Corp. Oak Ridge National Laboratory, Oak Ridge, TN (US)

( * ) Notice: Subject to any disclaimer, the term of this patent is extended or adjusted under 35 U.S.C. 154(b) by 0 days.

(21) Appl. No.: 09/396,062

(22) Filed: Sep. 15, 1999

(51) Int. Cl.[7] ..... F25B 47/02

(52) U.S. Cl. ..... 62/155; 62/156; 62/197; 62/277; 62/512; 62/DIG. 2

(58) Field of Search ..... 62/151, 155, 156, 62/234, 206, 277, 278, 81, 197, 512, 140, 222, 224, 225, DIG. 2

(56) References Cited

U.S. PATENT DOCUMENTS

| | | | | |
|---|---|---|---|---|
| 2,384,210 | | 9/1945 | Sunday | 62/115 |
| 2,667,757 | * | 2/1954 | Shoemaker | 62/197 X |
| 2,675,684 | * | 4/1954 | Shoemaker | 62/197 X |
| 2,679,141 | | 5/1954 | Philipp | 62/3 |
| 2,912,834 | | 11/1959 | Mann | 62/276 |
| 2,983,112 | | 5/1961 | Batteiger | 62/156 |
| 2,986,898 | | 6/1961 | Wood, Jr. | 62/174 |
| 3,563,054 | | 2/1971 | Lofgreen et al. | 62/512 |
| 3,677,025 | * | 7/1972 | Payne | 62/277 X |
| 3,698,204 | | 10/1972 | Schlottereck et al. | 62/206 |
| 4,083,195 | | 4/1978 | Kramer et al. | 62/196 B |
| 4,095,438 | | 6/1978 | Kramer | 62/278 |
| 4,345,441 | | 8/1982 | Hansen | 62/140 |
| 4,450,691 | * | 5/1984 | Taylor | 62/140 |
| 4,644,758 | | 2/1987 | Maehara et al. | 62/234 |
| 4,680,940 | * | 7/1987 | Vaughn | 62/155 |
| 4,798,058 | | 1/1989 | Gregory | 62/278 |
| 4,942,743 | | 7/1990 | Gregory | 62/503 |
| 5,000,009 | * | 3/1991 | Clanin | 62/225 X |
| 5,065,584 | | 11/1991 | Byczynski et al. | 62/81 |

(List continued on next page.)

FOREIGN PATENT DOCUMENTS

WO 82/01935 6/1982 (WO) .

*Primary Examiner*—Harry B. Tanner
(74) *Attorney, Agent, or Firm*—Needle & Rosenberg, P.C.

(57) ABSTRACT

An apparatus and method for warm-liquid defrosting of the evaporator of a refrigeration system. The apparatus includes a first refrigerant expansion device that selectively expands refrigerant for cooling the evaporator, a second refrigerant expansion device that selectively expands the refrigerant after the refrigerant has passed through the evaporator, and a defrosting control for the first refrigerant expansion device and second refrigerant expansion device to selectively defrost the evaporator by causing warm refrigerant to flow through the evaporator. The apparatus is alternately embodied with a first refrigerant bypass and/or a second refrigerant bypass for selectively directing refrigerant to respectively bypass the first refrigerant expansion device and the second refrigerant expansion device, and with the defrosting control connected to the first refrigerant bypass and/or the second refrigerant bypass to selectively activate and deactivate the bypasses depending upon the current cycle of the refrigeration system. The apparatus alternately includes an accumulator for accumulating liquid and/or gaseous refrigerant that is then pumped either to a refrigerant receiver or the first refrigerant expansion device for enhanced evaporator defrosting capability. The inventive method of defrosting an evaporator in a refrigeration system includes the steps of compressing refrigerant in a compressor and cooling the refrigerant in the condenser such that the refrigerant is substantially in liquid form, passing the refrigerant substantially in liquid form through the evaporator, and expanding the refrigerant with a refrigerant expansion device after the refrigerant substantially passes through the evaporator.

31 Claims, 2 Drawing Sheets

U.S. PATENT DOCUMENTS

| | | | | |
|---|---|---|---|---|
| 5,269,151 | | 12/1993 | Dinlh | 62/81 |
| 5,575,158 | | 11/1996 | Vogel | 62/196.4 |
| 5,694,782 | * | 12/1997 | Alsenz | 62/197 X |
| 5,887,440 | | 3/1999 | Dubé | 62/82 |
| 5,916,254 | | 6/1999 | Cho | 62/278 |
| 5,921,092 | | 7/1999 | Behr et al. | 62/81 |
| 6,000,231 | | 12/1999 | Alsenz | 62/81 |

* cited by examiner

APPARATUS AND METHOD FOR EVAPORATOR DEFROSTING

STATEMENT OF FEDERALLY SPONSORED RESEARCH

This invention was made with U.S. Government support under Contract No. DE-AC05-96OR22464, awarded by the U.S. Department of Energy to Lockheed Martin Energy Research Corporation, and the Government has certain rights in this invention.

BACKGROUND OF THE INVENTION

1. Field of the Invention

The present invention generally relates to refrigeration systems. More particularly, the present invention relates to apparatuses and methods for defrosting of an evaporator, and especially the evaporator coil, in a refrigeration system.

2. Description of the Related Art

Refrigeration systems are well known in the art and a closed-flow refrigeration system generally includes a compressor, a condenser and condenser fan, a refrigerant tube between the components, an expansion device such as a capillary tube, an evaporator that has an evaporator coil and an evaporator fan, and a thermostatic relay coupled to a power supply to engage the refrigeration system. In operation, the compressor cycles on and off to compress the refrigerant which then passes to the condenser which cools and liquefies the refrigerant and discharges excess heat from the refrigerant environment. The liquid refrigerant then passes to the evaporator and is expanded or vaporized in the evaporator and the expanding refrigerant absorbs the ambient heat of the evaporator such that the evaporator produces cooling, and ambient air is passed thereover by the evaporator fan and a stream of cool air is thus generated.

The cooling of the ambient air passing through the evaporator and around the evaporator coil causes condensate, and subsequently, frost to build up on the evaporator as the refrigeration system operates. Such frost must be removed in order for the evaporator to function properly and have convection with the evaporator adequately cool the ambient air during the refrigeration cycle. In order to minimize frost in the evaporator, most refrigeration systems therefore maintain activation of the evaporator fan to defrost the evaporator and evaporator coil when the refrigeration cycle is not active, i.e. the compressor and condenser are not running and compressed cooled refrigerant is not flowing.

There are other apparatuses and methods known in the art to defrost the evaporator coil in addition to the method of activating the evaporator fan while the refrigeration system otherwise cycles off. A hot gas defrosting system gathers hot gas from the discharge of the compressor and passes it through the evaporator in proximity to the evaporator coil through the use of an additional hot gas line with associated valves and controls. Furthermore, the use of hot gas for defrosting provides a thermal shock to the components of the evaporator that increases wear and necessity of repair of such components.

Electrical heating elements are sometimes provided in, or in proximity to, the evaporator and evaporator coil, or in conjunction with an evaporator fan to provide heat to the evaporator and evaporator coil sufficient for defrosting. The electrical elements, however, are quite inefficient and consume significant power in producing energy. Moreover, the use of electrical elements can also create a thermal shock to the evaporator components and cause deleterious effects similar to the use of a heat gas line.

Another known method of defrosting the evaporator is simply to cycle the compressor off for a sufficient duration to allow the evaporator to warm and the condensate thereupon to drain. However, such method is slow and unpractical for very cold refrigerant temperatures, i.e. far below 32° F., and is impractical for refrigeration systems that must provide a significant amount of refrigeration.

Accordingly, an apparatus and method of defrosting the evaporator and evaporator coil of a refrigeration system that is efficient, simple, and which does not cause a significant thermal shock to the evaporator components during defrosting would represent an improvement over the prior art evaporator defrosting devices and methods.

SUMMARY OF THE INVENTION

The present invention is an apparatus and method for defrosting an evaporator of a refrigeration system. A refrigeration system includes at least one compressor, at least one condenser, at least one evaporator, with a refrigerant tube in fluid communication with each compressor, condenser, and evaporator, with a refrigerant flowing through said refrigerant tube. The present refrigeration system also includes the inventive element of at least one first refrigerant expansion device in fluid communication with the refrigerant tube such that the refrigerant flows therethrough, and each first refrigerant expansion device is located in the refrigerant tube between each condenser and evaporator. The first refrigerant expansion device selectively expands or vaporizes the refrigerant passing therethrough prior to the refrigerant passing through the evaporator whereby the refrigerant absorbs ambient heat as it passes through the evaporator.

The present inventive refrigeration system, further, includes the inventive element of at least one second refrigerant expansion device in fluid communication with the refrigerant tube such that refrigerant flows therethrough, and the second refrigerant expansion device is located in the refrigerant tube between each evaporator and each compressor. The second refrigerant expansion device selectively expands refrigerant passing therethrough after the refrigerant has passed through the evaporator and before passing through a compressor. Thus, the second refrigerant expansion device allows the refrigerant to pass through the evaporator in liquid form with expansion of the refrigerant, and thus the cooling effect, occurring after. This capability allows the warmer liquid refrigerant to pass through the evaporator and evaporator coil thereby defrosting the evaporator, and then expands the refrigerant so that the refrigerant can be again compressed in the compressor and transported through the refrigerant tube.

Because the inventive refrigeration system controls when the refrigerant is expanded, the present inventive refrigeration system includes a defrosting control connected to each first refrigerant expansion device and each second refrigerant expansion device. The defrosting control therefore selectively defrosts an evaporator by deactivating the first refrigerant expansion device and activating the second refrigerant expansion device to allow the warm liquid refrigerant to pass through and defrost the evaporator. And once the refrigeration cycle has resumed, the first refrigerant expansion device is activated and the second refrigerant expansion device is deactivated to cause cooling expansion of the refrigerant to occur in the evaporator.

The defrosting control preferably includes a timer to have the defrosting cycle run for a predetermined duration. The defrosting control alternately includes one or more sensors to sense one or more parameters of the evaporation and the defrost control defrosts the evaporator upon a predetermined charge in the sensed parameter. One preferred sensor is a frost sensor on the evaporator coil which effects the defrosting of the evaporator while frost is detected.

In another embodiment, the inventive refrigeration system includes at least one first refrigerant bypass located in the refrigerant tube and the first refrigerant bypass selectively directs the refrigerant to bypass each first refrigerant expansion device. The first refrigerant bypass allows the use of a static refrigerant expansion device, such as a capillary tube, for the first refrigerant expansion device, and the defrosting control then activates or deactivates the refrigerant bypass instead of activating the first refrigerant expansion device directly. Accordingly, the inventive refrigeration system can alternately include at least one second refrigerant bypass located in the refrigerant tube and the second refrigerant bypass selectively directs the refrigerant to bypass each second refrigerant expansion device. When the refrigeration system includes a second refrigerant bypass, the defrosting control likewise is connected to each second refrigerant bypass and activates or deactivates the second refrigerant bypass directly in conjunction with the first refrigerant expansion device or first refrigerant bypass to control defrosting of the evaporator.

The present inventive refrigeration system alternately includes an accumulator that accumulates liquid and/or gaseous refrigerant after the refrigerant has passed through each evaporator and/or each second refrigerant expansion device. The refrigeration system also includes a pump with the accumulator and the pump directs the accumulated refrigerant to each first refrigerant expansion device or first refrigerant bypass. Accordingly, if the evaporator is so cold that one pass of warm liquid refrigerant at compression temperature is not adequately defrosting the evaporator, the refrigerant can be accumulated in the accumulator and pumped from the accumulator to the first refrigerant bypass or first refrigerant expansion device to again pass through the evaporator at a warmer temperature than if the refrigerant has been compressed after exiting the second refrigerant expansion device. When the accumulator is utilized, the refrigerant does not need to be fully expanded by the second refrigerant expansion device as the refrigerant is recirculated directly to the evaporators and thus does not require partial or full expansion in order to be compressed by the compressors.

The inventive refrigeration system further alternately includes a receiver that receives refrigerant from the condenser(s) and/or receives accumulated refrigerant pumped from the accumulator. The receiver passes the accumulated liquid refrigerant and/or compressed and cooled refrigerant from the condenser to each first refrigerant expansion device depending upon whether a refrigeration cycle or an evaporator defrosting cycle is occurring.

The present inventive refrigeration system accordingly provides an inventive defroster for the evaporator of a refrigeration system. The defroster includes the first refrigerant expansion device that selectively expands the refrigerant to cool the evaporator, the second refrigerant expansion device for that selectively expands the refrigerant after the refrigerant has passed through the evaporator, and the defrosting control that controls the activation of the first refrigerant expansion device and second refrigerant expansion device to selectively defrost the evaporator. The defroster is alternately embodied with the first refrigerant bypass and/or the second refrigerant bypass for selectively directing the refrigerant to respectively bypass the first refrigerant expansion device and the second refrigerant expansion device. The defrosting control is then likewise connected to the first refrigerant bypass and/or the second refrigerant bypass and selectively activates and deactivates the bypasses depending on the current cycle of the system.

The inventive evaporator defrosting device control therefore provides an inventive method for defrosting an evaporator in a refrigeration system having a compressor, a condenser, an evaporator and a refrigerant tube passing a refrigerant between the compressor, condenser, and evaporator. The inventive method includes the steps of compressing the refrigerant in the compressor and cooling the refrigerant in the condenser such that the refrigerant is substantially in liquid form, passing the refrigerant substantially in liquid form through the evaporator, and expanding the refrigerant with a refrigerant expansion device after the refrigerant substantially passes through the evaporator.

When the refrigeration system further includes an accumulator connected to the refrigerant tube between the evaporator and the compressor and a pump connected to the accumulator, the method further includes the steps of accumulating the refrigerant after it has passed through the evaporator, and pumping the accumulated refrigerant from the accumulator to the evaporator to thereby provide warm liquid refrigerant to the evaporator for defrosting. And when the refrigeration system includes a receiver, an accumulator, and a pump, the method further includes the steps of accumulating the refrigerant in the accumulator after the refrigerant has passed through the evaporator, and pumping the accumulated refrigerant from the accumulator to the receiver.

When the refrigeration system further includes a defrosting control having a timer, then the step of passing the refrigerant through the evaporator is passing the refrigerant through the evaporator for a predetermined duration. If the defrosting control is embodied with a sensor in the evaporator for sensing one or more parameters, such as frost, of the evaporator, then the step of passing the refrigerant through the evaporator is passing the refrigerant through the evaporator upon sensing a predetermined change in a sensed parameter, such as frost being detected.

Therefore it is the primary object of the present invention to provide an evaporator defroster that adequately defrosts an evaporator through the use of warm refrigerant that is passed through, but not expanded in, the evaporator. The present invention accordingly provides a refrigeration system that has commercial advantage as it provides efficient defrosting of the evaporator. The present invention also reduces thermal shock to evaporator components as it does not expose the evaporator components to a significant immediate temperature change during defrosting, which consequently reduces wear on the components of the refrigeration system. Furthermore, the present invention has industrial applicability as it can be installed in both existing and new refrigeration systems to improve the refrigeration system efficiency.

Other objects, advantages, and features of the present invention will become apparent after review of the hereinafter set forth Brief Description of the Drawings, Detailed Description of the Invention, and Claims.

DETAILED DESCRIPTION OF THE INVENTION

Figure 1:
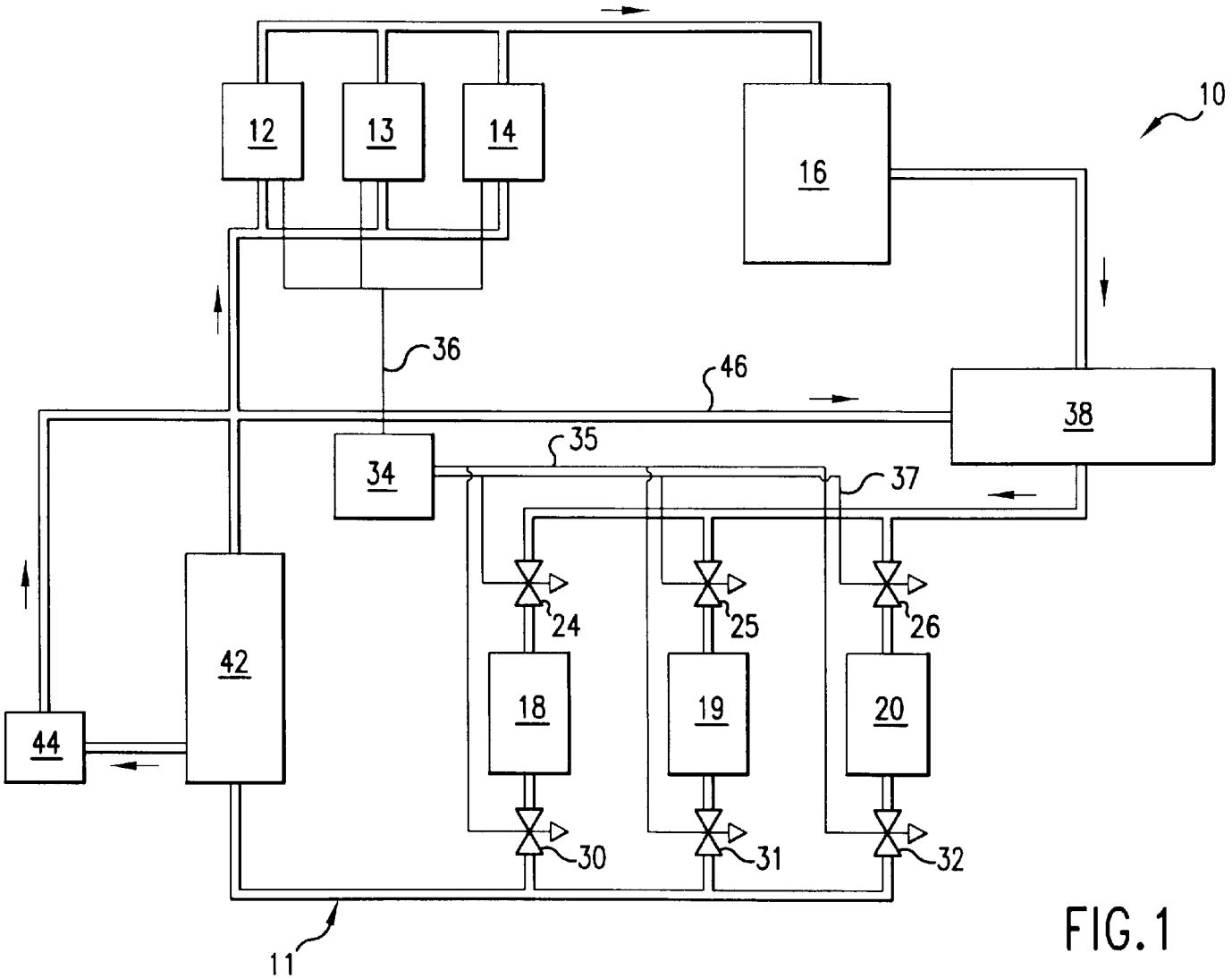
FIG. 1 is a representative diagram illustrating a refrigeration system embodied with a first and second expansion device on the refrigerant tube respectively before and after the refrigerant enters each evaporator, and a defrosting control that is connected to each expansion device.

Referring now to the drawings in which like numerals represent like components throughout the several views, FIG. 1 illustrates one embodiment of the presently inventive refrigeration system 10 comprised of compressors 12, 13, 14, condenser 16, and evaporators 18, 19, 20. There is at least one each of the compressor, condenser, and evaporator present as they are necessary components of a refrigeration system. The illustrated embodiment shows a plurality of compressors and evaporators in parallel, which is the most common embodiment in commercial refrigeration systems. The present inventive refrigeration system can be used with any number of components in parallel or otherwise.

The refrigeration system 10 includes a refrigerant tube 11 in fluid communication with each compressor 12, 13, 14, condenser 16, and evaporator 18, 19, 20, with a refrigerant flowing through the refrigerant tube 11. The refrigeration system 10 also includes first refrigerant expansion devices 24, 25, 26 in fluid communication with the refrigerant tube 11 such that the refrigerant flows therethrough, and each first refrigerant expansion device 24, 25, 26 is located in the refrigerant tube 11 between the condenser 16 and each evaporator 18, 19, 20. Each first refrigerant expansion device 24, 25, 26 selectively expands or vaporizes the refrigerant passing therethrough either prior to the refrigerant passing through the evaporators 18, 19, 20, or begins to expand or vaporize the refrigerant such that it is expanding in the evaporators 18, 19, 20, whereby the expanding refrigerant absorbs ambient heat as it passes through the evaporators 18, 19, 20.

Accordingly, the refrigeration cycle of the refrigeration system 10 is typical for the refrigeration art. The refrigerant is compressed in the compressors 12, 13, 14 and liquefied, and passes through the refrigerant tube 11 to the condenser 16. The condenser 16 then cools the liquefied refrigerant and passes it to the first expansion devices 24, 25, 26, where the refrigerant is expanded and enters the evaporators 18, 19, 20 and is fully expanded or vaporized therein to cool the evaporators 18, 19, 20. The expanded refrigerant then passes through the refrigerant tube 11 back to compressors 12, 13, 14 to begin the refrigeration cycle again.

The present inventive refrigeration system 10 has the novel capability of passing the compressed, liquefied refrigerant from the compressors 12, 13, 14, and the condenser 16, if engaged, through the evaporators 18, 19, 20 without expansion. Because the refrigerant is not expanded, the liquefied refrigerant travels through the evaporator, and the evaporator coil (not shown) at a temperature slightly above freezing (32° F.) or greater and accordingly will defrost the evaporator. The internal energy of the liquefied refrigerant is also transferred to the evaporator so the liquefied refrigerant exiting the evaporator will be cooler than when it entered the evaporator until a thermal equilibrium is reached between the flowing liquefied refrigerant and the evaporator and its components.

The defrosting cycle is therefore started when the first expansion devices 24, 25, 26 are deactivated to allow the unexpanded, liquefied refrigerant to flow through the evaporators. The refrigeration system 10 includes second refrigerant expansion devices 30, 31, 32 in fluid communication with the refrigerant tube 11 such that refrigerant flows from the respective evaporators 18, 19, 20, through the second refrigerant expansion devices 30, 31, 32 and back to the compressors 12, 13, 14. The second refrigerant expansion devices 18, 19, 20 selectively expand the liquefied refrigerant passing therethrough after the refrigerant has passed through the evaporators 18, 19, 20 in the defrosting cycle. The expansion of the refrigerant allows the refrigerant to again cycle through the compressors 12, 13, 14 and go through either a defrosting cycle or a refrigeration cycle. If the refrigerant were not expanded and pressure released after the defrosting cycle through the evaporators 18, 19, 20, then the refrigerant would be compressed until it approached critical volume, creating increasing strain on the compressor due to the resistance to compression of the refrigerant.

The refrigerant tube 11 alternately is in contact with a drain pan (not shown) that collects condensate from the evaporators 18, 19, 20 as the condensate builds and drains from the evaporators during the refrigeration cycle. The warm liquid refrigerant passing through the refrigerant tube 11 during the defrosting cycle can likewise defrost the drain pan and remove any frost or ice that has accumulated therein.

Due to the selective expansion of the refrigerant for defrosting, the refrigeration system 10 includes a defrosting control 34 connected at least to each first refrigerant expansion device 24, 25, 26, at connection line 35, and to each second refrigerant expansion device 30, 31, 32, at connection line 37. The defrosting control 34 can be an electrical or mechanical device that can execute simple or complex logic to activate and deactivate the refrigerant expansion devices, and the first refrigerant expansion devices 24, 25, 26 and second refrigerant expansion devices 30, 31, 32 are preferably electronic expansion valves in the refrigerant tube 11. The defrosting control 34 is alternately embodied as connected to either the first refrigerant expansion devices 24, 25, 26 or second refrigerant expansion devices 30, 31, 32, and/or other components as described herein. Defrosting control 34 selectively defrosts the evaporator 18, 19, 20 by deactivating the first refrigerant expansion devices 24, 25, 26 and activating the second refrigerant expansion devices 30, 31,32 to allow the liquid refrigerant to pass through the evaporators 18, 19, 20. And once the refrigeration cycle has resumed, the defrosting control 34 activates first refrigerant expansion devices 24, 25, 26 and the second refrigerant expansion devices 30, 31,32 are deactivated to cause cooling expansion of the refrigerant to once again occur in the evaporator. Defrosting control 34 is shown as connected, at connection line 36, to the compressors 12, 13, 14, and can activate the compressors 12, 13, 14 to control the cycle of the refrigeration system 10.

Defrosting control 34 preferably includes a timer for selecting a predetermined duration of defrosting of the evaporators 18, 19, 20, such that the defrosting cycle does not last for too long a period so as to unduly interfere with the refrigeration cycle. Because the defrosting control 34 as embodied in refrigeration system 10 is connected to the compressors 12, 13, 14, the timer of the defrosting control 34 preferably synchronizes the cycling of the compressors 12, 13, 14 and the refrigeration cycle with periodic defrosting of the evaporators 18, 19, 20.

The present inventive refrigeration system 10 alternately includes an accumulator 42 that accumulates liquid and/or gaseous refrigerant after the refrigerant has passed through each evaporator 18, 19, 20 during the refrigeration cycle and/or each second refrigerant expansion device 30, 31, 32 during the defrosting cycle. When so embodied, the refrigeration system 10 also includes a pump 44 in fluid communication with the accumulator 42, and the pump 44 selectively directs the accumulated refrigerant to each first refrigerant expansion device 24, 25, 26, or to a central receiver 38 which holds refrigerant prior to the refrigerant being passed to the evaporator(s). The receiver 38 alternately receives refrigerant from the condensers 12, 13, 14, when not receiving accumulated refrigerant pumped from the accumulator 42 through refrigerant tube 46. The receiver 38 passes the accumulated refrigerant and/or compressed and cooled refrigerant from the condenser 16 to each first refrigerant expansion device 24, 25, 26 where the refrigerant is then either expanded or passed through depending upon whether refrigeration cycle or an evaporator defrosting cycle is occurring.

Accordingly, if the evaporators 18, 19, 20 are so cold and frosted that one pass of warm liquid refrigerant at its compression temperature from the compressors 12, 13, 14, is not adequate for defrosting the evaporators 18, 19, 20, then the refrigerant is accumulated in the accumulator 42 and pumped from the accumulator 42, (alternately to the receiver 38 in refrigerant tube 46), to the first refrigerant expansion devices 24, 25, 26 to again pass the warmer refrigerant through the evaporators 18, 19, 20. Because the refrigerant has gone from the accumulator 42 back to the first expansion devices 24, 25, 26 without going through compressors 12, 13, 14, the refrigerant is at a warmer temperature than if the refrigerant has been again compressed, which provides increased defrosting capability to the refrigeration system 10.

Furthermore, when the accumulator 42 is utilized in the refrigerant tube 11 and all refrigerant accumulated therein is routed to the receiver 38 and/or the first refrigerant expansion devices 24, 25, 26, the use of the second refrigerant expansion devices 30, 31, 32, can be partially or fully omitted. In such operation, the compressed, warm liquid refrigerant is cycled back to the accumulator 42 instead of directly to the compressors 12, 13, 14, and consequently, the refrigerant does not require significant expansion during the defrosting cycle. However, depending upon the type of pump 44 used, the pump 44 might compress the refrigerant in pressurizing the refrigerant for transport to either the receiver 38 or the first refrigerant expansion devices 24, 25, 26, and accordingly, some refrigerant expansion must occur prior to recirculating the refrigerant from the accumulator 42 to ease pressure on pump 44 from increasing refrigerant compression resistance. The accumulator 42 alternately can include an expansion device to expand refrigerant entering or exiting the accumulator 42, if necessary.

The refrigeration system 10 as embodied with the accumulator 42 and the pump 44 is particularly suited for use in a commercial application where a significant amount of refrigeration is needed. Also, the recirculation of the warm liquid refrigerant is advantageous in refrigeration systems that are subject to extremes of temperature and humidity that both contribute to increased frost build-up in the evaporator and on the evaporator coil.

The refrigeration system 10 can be modified to include additional heating elements along the refrigerant tube 11 for adding heat to the liquid refrigerant to defrost the evaporator under extreme conditions. The inclusion of an electrical heating element along the refrigerant tube 11 in proximity to the first refrigerant expansion devices 24, 25, 26 is one example of such modification. A heating device can also be included in the accumulator 42 to heat the liquid refrigerant prior to recirculation of the refrigerant. Other heating devices and methods known in the art are alternately incorporated into the present inventive refrigeration system such that heat is supplied to the liquid refrigerant for enhanced defrosting capability.

Figure 2:
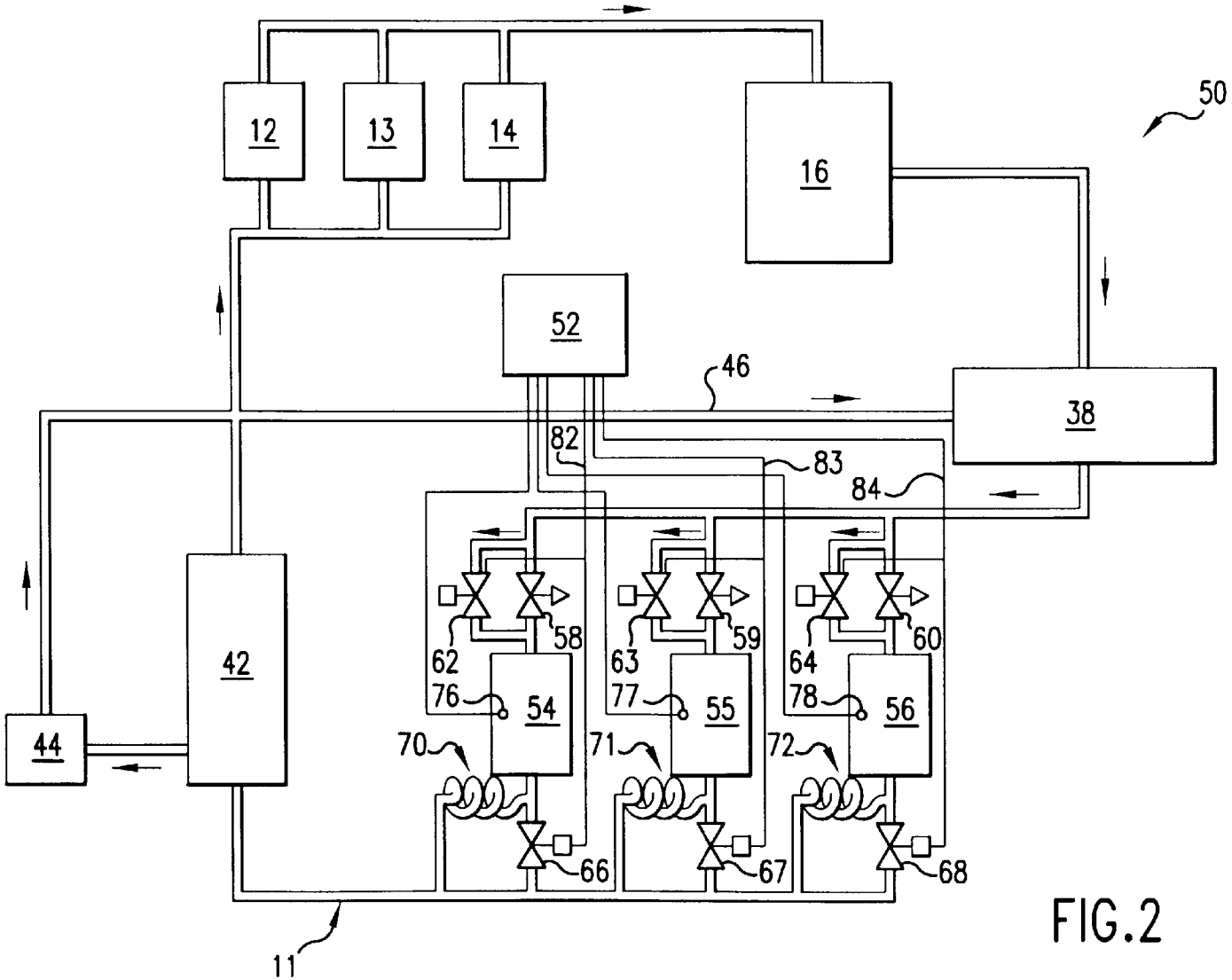
FIG. 2 is a representative diagram illustrating a refrigeration system embodied with a feedback-controlled defrosting control that includes a sensor in each evaporator, and a first and second refrigerant bypass for having the refrigerant bypass the first and second refrigerant expansion devices respectively.

With reference to FIG. 2, another embodiment of the inventive refrigeration system 50 is illustrated which includes a feedback-controlled defrosting control 52 for defrosting evaporators 54, 55, 56. Evaporators 54, 55, 56 are embodied with first refrigerant expansion devices 58, 59, 60 located in the refrigerant tube and first refrigerant bypasses 62, 63, 64 that selectively direct the refrigerant to bypass each first refrigerant expansion device 58, 59, 60. The first refrigerant bypasses 62, 63, 64 allow the use of a static refrigerant expansion device, such as a capillary tube, for the first refrigerant expansion device, in contrast to the electronic expansion valves 24, 25, 26 that are the first refrigerant expansion devices of the embodiment of FIG. 1.

Refrigeration system 50 further includes second refrigerant bypasses 66, 67, 68 for second refrigerant expansion devices 70, 71, 72, the refrigerant expansion devices being illustrated as capillary tubes. The second refrigerant bypasses 66, 67, 68 selectively direct the refrigerant to bypass each second refrigerant expansion device 70, 71, 72 and thus, expansion in the second refrigerant expansion device. When the refrigeration system includes a second refrigerant bypass 66, 67, 68, the defrosting control 52 is connected to each of the first refrigerant bypasses 58, 59, 60 and the second refrigerant bypass, shown as connections 82, 83, 84, and activates or deactivates the second refrigerant bypasses 66, 67, 68 instead of the second refrigerant expansion devices to control refrigeration and defrosting. As shown in FIG. 2, the defrosting control 52 activates or deactivates the first refrigerant bypasses 62, 63, 64 instead of the first refrigerant expansion devices 58, 59, 60 directly in conjunction with the activation of the second refrigerant expansion devices 70, 71, 72 to begin defrosting the evaporator.

Furthermore, defrosting control 52 includes sensors 76, 77, 78 on the evaporators 54, 55, 56, and each sensor senses one or more parameters of the evaporator and the defrosting control 52 selectively activates the defrosting cycle upon sensing a predetermined change in one or more of the sensed parameters. The sensors 76, 77, 78 are embodied as frost sensors on the evaporator coils (not shown) of evaporators 54, 55, 56, and defrosting control 52 begins the evaporator defrosting cycle by opening first refrigerant bypasses 62, 63, 64 and closing second refrigerant bypasses 66, 67, 68, upon frost being sensed in the evaporators. Thus, liquid refrigerant then bypasses the first refrigerant expansion devices 58, 59, 60, and flows through the evaporators 18, 19, 20 whereupon the liquid refrigerant is then expanded in a respective one of the second refrigerant expansion devices (capillary tube 70, 71, 72). The defrosting control 52 and sensors 76, 77, 78 alternately sense moisture, temperature, conductivity, or any other parameter by which it can be determined if frost build-up is occurring or has occurred in the evaporators 54, 55, 56.

With reference again to FIG. 1, the present inventive refrigeration system accordingly provides an inventive defroster for the evaporator of a refrigeration system 10. The defroster includes the first refrigerant expansion devices 24, 25, 26 that selectively expand the refrigerant to cool the evaporators 18, 19, 20. The defroster further includes the second refrigerant expansion devices 30, 31, 32 that selectively expand the refrigerant after the refrigerant has passed through the evaporators 18, 19, 20, whereby the warm liquid refrigerant passes through the evaporators 18, 19, 20 and defrosts the evaporator components. The defroster also includes a defrosting control 34 that controls the first refrigerant expansion devices 24, 25, 26 and the second refrigerant expansion devices 30, 31, 32 to selectively defrost the evaporators 18, 19, 20. When the refrigeration system, such as refrigeration system 50 in FIG. 2, is alternately embodied with the first refrigerant bypasses 62, 63, 64 and/or the second refrigerant bypasses 66, 67, 68, that selectively direct the refrigerant to bypass the first refrigerant expansion devices 58, 59, 60 and the second refrigerant expansion devices 70, 71, 72, respectively, the defrosting control 52 of the defroster is then connected to the first refrigerant bypasses 62, 63, 64 and/or the second refrigerant bypasses 66, 67, 68 to selectively activate and deactivate the bypasses depending on the current cycle of the system.

Thus, as shown in FIGS. 1 and 2, it can be seen that t the inventive system provides an inventive method of defrosting an evaporator in a refrigeration system that has a compressor, a condenser, an evaporator and a refrigerant tube passing a refrigerant between the compressor, condenser, and evaporator. The inventive method includes the step of compressing the refrigerant in the compressor(s), such as compressors 12, 13, 14, and cooling the refrigerant in the condenser, such as condenser 16, such that the refrigerant is substantially in liquid form. The method then includes the step of passing the refrigerant substantially in liquid form through the evaporator, or evaporators 18, 19, 20 which thereby defrosts the evaporator(s). The method finally includes the step of expanding the refrigerant with a refrigerant expansion device, such as second refrigerant expansion devices 30, 31, 32 after the refrigerant substantially passes through the evaporator, or evaporators 18, 19, 20.

When the refrigeration system further includes an accumulator, such as accumulator 42 connected to the refrigerant tube between the evaporator and the compressor and a pump, such as pump 44, connected to the accumulator 42, the inventive method further includes the steps of accumulating the refrigerant after it has passed through the evaporator, or evaporators 18, 19, 20, and pumping the accumulated refrigerant from the accumulator 42 to the evaporator(s) to thereby provide warm refrigerant to the evaporator(s) for defrosting. And when the refrigeration system further includes a receiver, such as receiver 38, an accumulator 42, and a pump 44, the inventive method further includes the steps of accumulating the refrigerant in the accumulator 42 after the refrigerant has passed through the evaporator(s), and pumping the accumulated refrigerant from the accumulator 42 to the receiver 38.

The present inventive method inherently controls the defrosting step as shown by the refrigeration system 10 of FIG. 1, which includes a defrosting control 34 having a timer. When so embodied, then the step of the method of passing the refrigerant through the evaporator(s) is passing the refrigerant through the evaporator(s) for a predetermined duration, such duration ideally sufficient to substantially defrost the evaporator(s). And if the defrosting control is embodied with a sensor in the evaporator(s) for sensing one or more parameters of the evaporator(s), such as defrosting control 52 in FIG. 2, with sensors 76, 77, 78, sensing frost, then the step of passing the refrigerant through the evaporator(s) is passing the refrigerant through the evaporator(s) upon sensing a predetermined change in a sensed parameter, such as frost being detected in the evaporator 54, 55, 56 in FIG. 2.

While there has been shown the preferred and alternate embodiments of the present invention, it is to be understood that certain changes can be made in the forms and the arrangement of the elements and in the steps of the inventive method without departing from the spirit and scope of the invention as set forth in the Claims appended herewith. In addition, all elements recited in means-plus-function language are intended to include any structure, material, or act for performing the recited function in combination with the other claimed elements as would be known to one of skill in the art.

What is claimed is:

1. A refrigeration system, comprising:

at least one compressor;

at least one condenser;

at least one evaporator;

a refrigerant tube in fluid communication with each said compressor, said condenser, and said evaporator, a refrigerant flowing through said refrigerant tube;

at least one first refrigerant expansion device in fluid communication with said refrigerant tube such that the refrigerant flows therethrough, each said first refrigerant expansion device located in said refrigerant tube between each said condenser and each said evaporator, and each said first refrigerant expansion device selectively expanding refrigerant passing therethrough prior to the refrigerant passing through said evaporator;

at least one second refrigerant expansion device in fluid communication with said refrigerant tube such that refrigerant flows therethrough, each said second refrigerant expansion device located in said refrigerant tube between each said evaporator and each said compressor, and each said second refrigerant expansion device selectively expanding refrigerant passing therethrough prior to the refrigerant passing through each said compressor; and a defrosting control connected to each said first refrigerant expansion device and each said second refrigerant expansion device, said defrosting control selectively defrosting each said evaporator.

2. The refrigeration system of claim 1, further comprising at least one first refrigerant bypass located in said refrigerant tube for selectively bypassing each said first refrigerant expansion device.

3. The refrigeration system of claim 2, further comprising at least one second refrigerant bypass located in said refrigerant tube for selectively bypassing each said second refrigerant expansion device.

4. The refrigeration system of claim 3, wherein said defrosting control is connected to each said first refrigerant bypass and each said second refrigerant bypass.

5. The refrigeration system of claim 3, further comprising:

an accumulator for accumulating refrigerant after the refrigerant has passed through each said evaporator and/or said each second refrigerant expansion device; and a pump for directing the accumulated refrigerant to each said first refrigerant expansion device.

6. The refrigeration system of claim 5, further comprising a receiver for receiving refrigerant from each said condenser and/or receiving accumulated refrigerant from said pump, said receiver passing the accumulated refrigerant to each said first refrigerant expansion device.

7. The refrigeration system of claim 1, wherein each said first refrigerant expansion device and each said second refrigerant expansion device comprises an electronic expansion valve in the refrigerant tube.

8. The refrigeration system of claim 3, wherein each said first refrigerant bypass and each said second refrigerant bypass comprises a solenoid valve in the refrigerant tube.

9. The refrigeration system of claim 1, wherein said defrosting control includes a timer for controlling the duration of defrosting of each said evaporator.

10. The refrigeration system of claim 1, wherein said defrosting control includes at least one sensor on each said evaporator, each said sensor sensing one or more parameters of each said evaporator, and said defrosting control selectively defrosting each said evaporator upon a predetermined change in one or more of the sensed parameters.

11. The refrigeration system of claim 10, wherein each said sensor senses frost on each said evaporator, and said defrosting control defrosts each said evaporator while frost is being sensed thereupon.

12. The refrigeration system of claim 3, wherein each said first refrigerant expansion device and each said second refrigerant expansion device comprises a capillary tube.

13. A defroster for the evaporator of a refrigeration system having a refrigerant tube passing a flow of refrigerant through an evaporator, said defroster comprising:

a first refrigerant expansion means for selectively substantially expanding the refrigerant before the refrigerant passes through the evaporator;

a second refrigerant expansion means for selectively substantially expanding the refrigerant after the refrigerant has passed through the evaporator; and defrosting control means for controlling said first refrigerant expansion means and said second refrigerant expansion means to selectively defrost the evaporator.

14. The defroster of claim 13, further comprising:

a first refrigerant bypass means for selectively directing the refrigerant to substantially bypass said first refrigerant expansion means;

a second refrigerant bypass means for selectively directing the refrigerant to substantially bypass said second refrigerant expansion means; and wherein said defrosting control means further controlling said first refrigerant bypass means and said second refrigerant bypass means to selectively defrost the evaporator.

15. The defroster of claim 13, further comprising:

an accumulator means for accumulating refrigerant after the refrigerant has passed through the evaporator and/or said second refrigerant expansion means; and a pump for directing the accumulated refrigerant to said first refrigerant expansion means.

16. The defroster of claim 15, further comprising receiving means for receiving accumulated refrigerant from said accumulator means, said receiving means passing the accumulated refrigerant to said first refrigerant expansion means.

17. The defroster of claim 13, wherein said first refrigerant expansion means and said second refrigerant expansion means comprise electronic expansion valves in the refrigerant tube.

18. The defroster of claim 14, wherein said first refrigerant bypass means and said second refrigerant bypass means comprise solenoid valves in the refrigerant tube.

19. The defroster of claim 13, wherein said defrosting control means includes timing means for controlling the duration of defrosting of the evaporator.

20. The defroster of claim 13, wherein said defrosting control means includes at least one sensor on the evaporator, each said sensor sensing one or more parameters of the evaporator, and said defrosting control means selectively defrosting the evaporator upon a predetermined change in one or more of the sensed parameters.

21. The defroster of claim 20, wherein said sensor senses frost on the evaporator and said defrosting means defrosts the evaporator while frost is sensed upon the evaporator.

22. The defroster of claim 14, wherein said first refrigerant expansion means and said second refrigerant expansion means comprise capillary tubes.

23. A method of defrosting an evaporator of a refrigeration system, the refrigeration system having a compressor, a condenser, an evaporator and a refrigerant tube passing a refrigerant between the compressor, condenser, and evaporator, the method comprising the steps of:

compressing the refrigerant in the compressor and cooling the refrigerant in the condenser such that the refrigerant is substantially in liquid form;

passing the refrigerant substantially in liquid form through a first refrigerant expansion device and into the evaporator; and selectively expanding the liquid refrigerant with a second refrigerant expansion device after the refrigerant has substantially passed through the evaporator.

24. The method of claim 23, wherein the refrigeration system further includes an accumulator connected to the refrigerant tube between the evaporator and the compressor and a pump connected to the accumulator, the pump including a refrigerant tube extending to the evaporator, the method further comprising the steps of:

accumulating the refrigerant after the refrigerant has passed through the evaporator; and pumping the accumulated refrigerant from the accumulator to the evaporator to thereby provide warm substantially liquid refrigerant to the evaporator for defrosting.

25. The method of claim 23, wherein the refrigeration system further includes a receiver for receiving refrigerant located in the refrigerant tube between the condenser and the evaporator, an accumulator connected to the refrigerant tube between the evaporator and the compressor, and a pump connected to the accumulator and a refrigerant from the pump tube to the receiver, the method further comprising the steps of:

accumulating refrigerant in the accumulator after the refrigerant has passed through the evaporator; and pumping the accumulated refrigerant from the accumulator to the receiver.

26. The method of claim 23, wherein the refrigeration system further includes a defrosting control having a timer, the defrosting control controlling the passing of liquid refrigerant through the evaporator, and wherein the step of passing the refrigerant through the evaporator is passing the refrigerant through the evaporator for a predetermined duration.

27. The method of claim 23, wherein the refrigeration system further includes a defrosting control controlling the passing of liquid refrigerant through the evaporator, the defrosting control having a sensor in the evaporator for sensing one or more parameters of the evaporator, and wherein the step of passing the refrigerant through the evaporator is passing the refrigerant through the evaporator upon sensing a predetermined change in a sensed parameter.

28. The method of claim 27, wherein the sensor senses frost on the evaporator, and wherein the step of passing the refrigerant through the evaporator upon sensing a predetermined change in a sensed parameter is passing the refrigerant through the evaporator while frost is sensed on the evaporator.

29. A defroster for use with the evaporator of a refrigeration system, the refrigeration system having a refrigerant tube passing a flow of refrigerant through an evaporator, said defroster comprising:

a first refrigerant expansion device for selectively substantially expanding the refrigerant before the refrigerant passes through the evaporator;

a second refrigerant expansion device for selectively substantially expanding the refrigerant after the refrigerant has passed through the evaporator;

an accumulator for accumulating the refrigerant after the refrigerant has passed through the evaporator and/or said second refrigerant expansion device;

a pump for directing the accumulated refrigerant to said first refrigerant expansion device; and defrosting control means for controlling said first refrigerant expansion device and said second refrigerant expansion device to selectively defrost the evaporator.

30. A method of defrosting the evaporator of a refrigeration system, the refrigeration system having a compressor, a condenser, an evaporator, a refrigerant tube passing a refrigerant between the compressor, the condenser, and the evaporator, an accumulator connected to the refrigerant tube between the evaporator and the compressor, and a pump connected to the accumulator, the pump having a refrigerant tube extending to the evaporator, the method comprising the steps of:

compressing the refrigerant in the compressor;

cooling the refrigerant in the condenser such that the refrigerant is substantially in liquid form;

passing the refrigerant substantially in liquid form through the evaporator;

expanding the refrigerant with a refrigerant expansion device after the refrigerant has substantially passed through the evaporator;

accumulating the expanded refrigerant in the accumulator; and pumping the accumulated refrigerant from the accumulator to the evaporator to thereby provide warm substantially liquid refrigerant to the evaporator for defrosting.

31. A refrigeration system, comprising:

at least one compressor;

at least one condenser;

at least a pair of evaporators;

a refrigerant tube in fluid communication with said at least one compressor, said at least one condenser, and each said evaporator, and a refrigerant flowing through said tube;

the evaporators being in parallel with respect to one another and the flow of the refrigerant therethrough within the system;

a first refrigerant expansion device for each said evaporator in said refrigerant tube and in fluid communication with said at least one condenser and its respective evaporator such that the refrigerant flows therethrough;

a second refrigerant expansion device for each said evaporator in said refrigerant tube in fluid communication with its respective evaporator and said at least one compressor such that the refrigerant flows therethrough;

a first refrigerant bypass for each said evaporator in said refrigerant tube for selectively bypassing said first refrigerant expansion device;

a second refrigerant bypass for each said evaporator in said refrigerant tube for selectively bypassing each said second refrigerant expansion device; and a defrosting control connected to each said first refrigerant bypass and each said second refrigerant bypass, respectively, said defrosting control being constructed and arranged to selectively defrost each of said at least two evaporators separately of one another.

* * * * *